US009435596B2

(12) United States Patent
Daniel et al.

(10) Patent No.: US 9,435,596 B2
(45) Date of Patent: Sep. 6, 2016

(54) SYSTEMS AND METHODS FOR RETAINING AN EXTRACTOR PIN IN A BOLT CARRIER GROUP OF A FIREARM

(71) Applicant: Daniel Defense, Inc., Black Creek, GA (US)

(72) Inventors: Marvin C. Daniel, Pooler, GA (US); Clinton Wade Lynch, Irmo, SC (US)

(73) Assignee: Daniel Defense, Inc., Black Creek, GA (US)

( * ) Notice: Subject to any disclaimer, the term of this patent is extended or adjusted under 35 U.S.C. 154(b) by 0 days.

(21) Appl. No.: 14/952,100

(22) Filed: Nov. 25, 2015

(65) Prior Publication Data

US 2016/0178302 A1 Jun. 23, 2016

Related U.S. Application Data

(60) Provisional application No. 62/093,766, filed on Dec. 18, 2014.

(51) Int. Cl.

| | |
|---|---|
| ***F41A 15/00*** | (2006.01) |
| ***F41A 15/14*** | (2006.01) |
| ***F41A 3/16*** | (2006.01) |
| ***F41A 3/26*** | (2006.01) |

(52) U.S. Cl.
CPC ..... *F41A 15/14* (2013.01); *F41A 3/16* (2013.01); *F41A 3/26* (2013.01)

(58) Field of Classification Search
CPC ..... F41A 15/14; F41A 3/16; F41A 3/26
USPC ..... 42/25
See application file for complete search history.

(56) References Cited

U.S. PATENT DOCUMENTS

| | | | | |
|---|---|---|---|---|
| 4,676,017 | A * | 6/1987 | Hurlemann | F41A 15/14 42/25 |
| 5,499,569 | A * | 3/1996 | Schuetz | F41A 15/12 42/25 |
| 5,520,019 | A * | 5/1996 | Schuetz | F41A 15/12 42/49.02 |
| 5,911,173 | A | 6/1999 | Westrom | |
| 6,044,748 | A | 4/2000 | Westrom | |
| 6,182,389 | B1 * | 2/2001 | Lewis | F41A 3/26 42/16 |
| 6,256,915 | B1 * | 7/2001 | da Silveira | F41A 9/53 42/1.05 |
| 6,484,430 | B1 | 11/2002 | Robinson et al. | |
| 6,609,319 | B1 | 8/2003 | Olson | |
| 7,627,974 | B2 | 12/2009 | Olson | |
| 7,735,410 | B2 * | 6/2010 | Clark | F41A 15/14 42/25 |
| 8,069,600 | B2 | 12/2011 | Rousseau et al. | |
| 8,695,260 | B2 | 4/2014 | Kramer | |
| 8,826,576 | B2 | 9/2014 | Lewis | |
| 8,844,424 | B2 | 9/2014 | Gomez | |
| 8,887,426 | B2 * | 11/2014 | Feese | F16F 1/36 42/25 |
| 8,950,312 | B2 | 2/2015 | Gomez | |
| 8,966,800 | B1 * | 3/2015 | Olson | F41A 15/14 42/25 |
| 8,991,295 | B2 * | 3/2015 | Larue | F41A 5/24 42/16 |
| 2010/0122483 | A1 * | 5/2010 | Clark | F41A 15/14 42/69.02 |

(Continued)

*Primary Examiner* — Michelle R Clement
(74) *Attorney, Agent, or Firm* — Sutherland Asbill & Brennan LLP; Jeremy Spier; Malvern Griffin

(57) ABSTRACT

A bolt carrier group of a firearm is disclosed. The bolt carrier group may include a bolt comprising a passage, an extractor comprising a hole, and an extractor pin comprising an elongated circular body positioned within the passage and the hole to pivotably attach the extractor to the bolt. The extractor pin may include a transverse tab extending from one end of the elongated circular body.

20 Claims, 2 Drawing Sheets

(56) References Cited

U.S. PATENT DOCUMENTS

2012/0047786 A1* 3/2012 Dextraze ..... F41A 3/18 42/18
2012/0055058 A1* 3/2012 Picard ..... F41A 3/26 42/16
2012/0073177 A1* 3/2012 Laney ..... F42B 5/025 42/16
2012/0266512 A1* 10/2012 Langevin ..... F41A 15/14 42/14
2013/0326924 A1* 12/2013 Jarboe ..... F41A 3/18 42/17
2014/0090283 A1* 4/2014 Gomez ..... F41A 3/26 42/25
2014/0259842 A1* 9/2014 Feese ..... F16F 1/36 42/25
2016/0116240 A1* 4/2016 Gomez ..... F41A 3/26 42/25

* cited by examiner

SYSTEMS AND METHODS FOR RETAINING AN EXTRACTOR PIN IN A BOLT CARRIER GROUP OF A FIREARM

CROSS-REFERENCE TO RELATED APPLICATIONS

The disclosure claims priority to and the benefit of U.S. provisional application No. 62/093,766, filed Dec. 18, 2014, which is herein incorporated by reference in its entirety.

FIELD OF THE DISCLOSURE

The disclosure generally relates to firearms and more particularly relates to systems and methods for retaining an extractor pin in a bolt carrier group of a firearm.

BACKGROUND

Extractors in a typical bolt carrier group of an AR-15 firearm pivot about an extractor pin that is retained laterally in the bolt by the bolt carrier. In certain embodiments, the pivot point may be moved to enhance extractor function, which may leave the extractor pin unsupported and prone to move out of alignment, causing firearm malfunction. To mitigate this effect, small clips, detents, and springs, or some combination thereof are often used to secure the extractor pin in its correct orientation. These methods are often costly to manufacture, difficult to maintain, and due to their small size, not very robust in extended operation.

SUMMARY

Some or all of the above needs and/or problems may be addressed by certain embodiments of the disclosure. In one embodiment, a bolt carrier group of a firearm is disclosed. The bolt carrier group may include a bolt comprising a passage, an extractor comprising a hole, and an extractor pin comprising an elongated circular body positioned within the passage and the hole to pivotably attach the extractor to the bolt. The extractor pin may include a transverse tab extending from one end of the elongated circular body.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
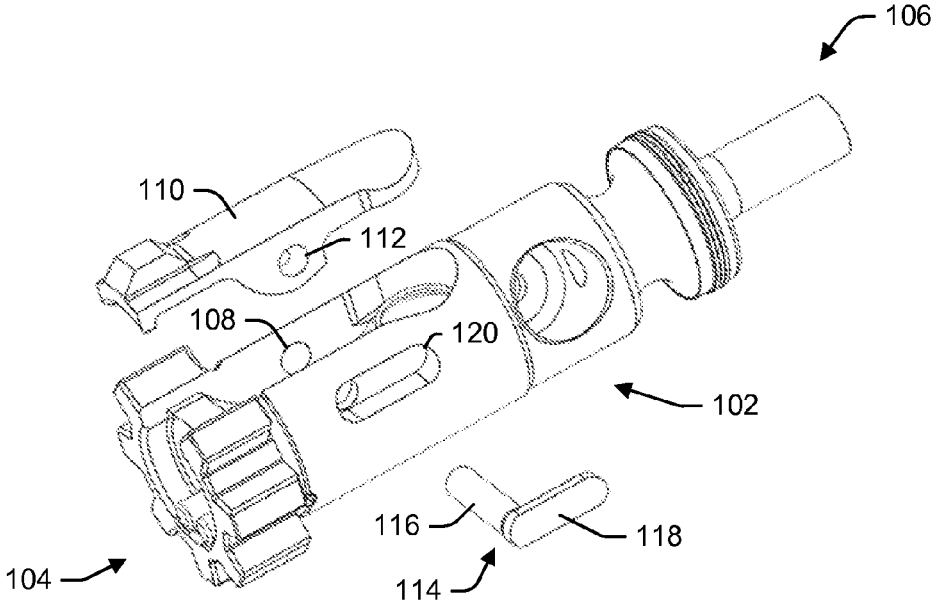
FIG. 1 depicts a perspective view of a bolt of a firearm in accordance with one or more embodiments of the disclosure.

Described below are embodiments of systems and methods for retaining an extractor pin in a bolt carrier group of a firearm. Methods of manufacturing, using, and installing the bolt carrier group are also disclosed. The firearm may be a conventional firearm. For example, the firearm may be an M-16 style rifle, an AR-15 style rifle, an AR-10 style rifle, or an M-4 style rifle, among others. Any type of firearm (including rifles, handguns, shotguns, or the like) may be used.

Generally speaking, the bolt carrier group may include a bolt comprising a passage, an extractor comprising a hole, and an extractor pin comprising an elongated circular body positioned within the passage and the hole to pivotably attach the extractor to the bolt. In some instances, the extractor pin may include a transverse tab extending from one end of the elongated circular body. Similarly, an outer surface of the bolt may include a slot that corresponds to the tab. In this manner, the tab may nests within the slot. Accordingly, when the bolt is positioned within a bolt carrier, the bolt carrier may at least partially surround the tab and slot to retain the tab within the slot. In order to remove the extractor pin from the bolt, the bolt may be removed from the bolt carrier.

In certain embodiment, the slot may extend rearward from the passage. For example, the slot may extend rearward from the passage parallel to an axial axis of the bolt. In other instances, the outer surface of the tab may be slightly recessed within the slot such that it is offset below the outer surface of the bolt.

The tab and slot ensure correct position and alignment of the extractor pin in a simple, rugged package. The tab and slot provide a number of technical advantages and/or solutions. For example, the tab and slot enable the extractor pin to be located at various locations along the bolt, allowing for a larger spring pocket (to accommodate a stronger-force spring). The tab and slot also prevent the extractor pin from being removed from the bolt while the firearm is in operation.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-4 depict example embodiments of various systems and methods for retaining an extractor pin in a bolt carrier group of a firearm. The firearm may be a conventional firearm. For example, the firearm may be an M-16 style rifle, an AR-15 style rifle, an AR-10 style rifle, or an M-4 style rifle, among others. Any type of firearm (including rifles, pistols, handguns, shotguns, or the like) may be used.

Figure 2:
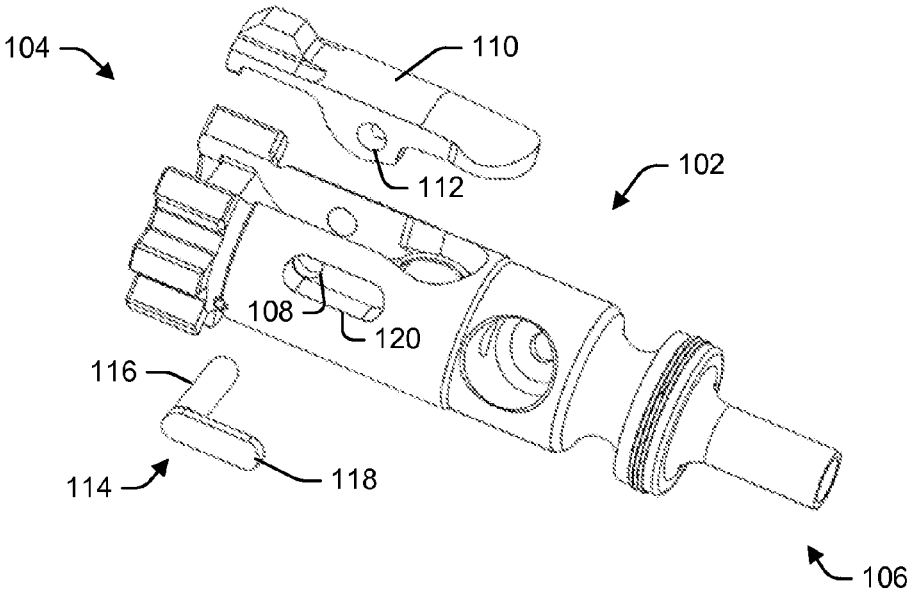
FIG. 2 depicts a perspective view of a bolt of a firearm in accordance with one or more embodiments of the disclosure.
Figure 3:
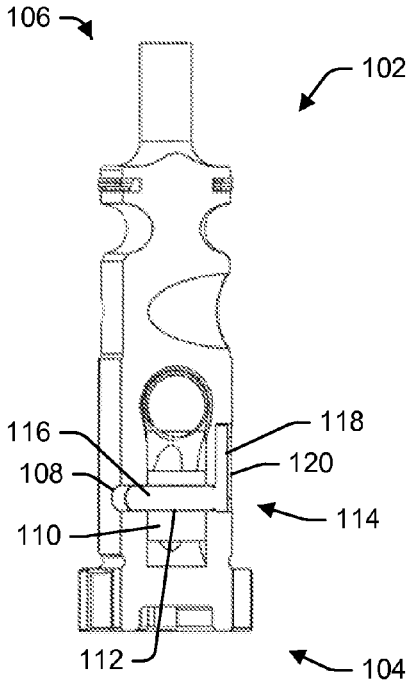
FIG. 3 depicts a cross-sectional view of a bolt of a firearm in accordance with one or more embodiments of the disclosure.
Figure 4:
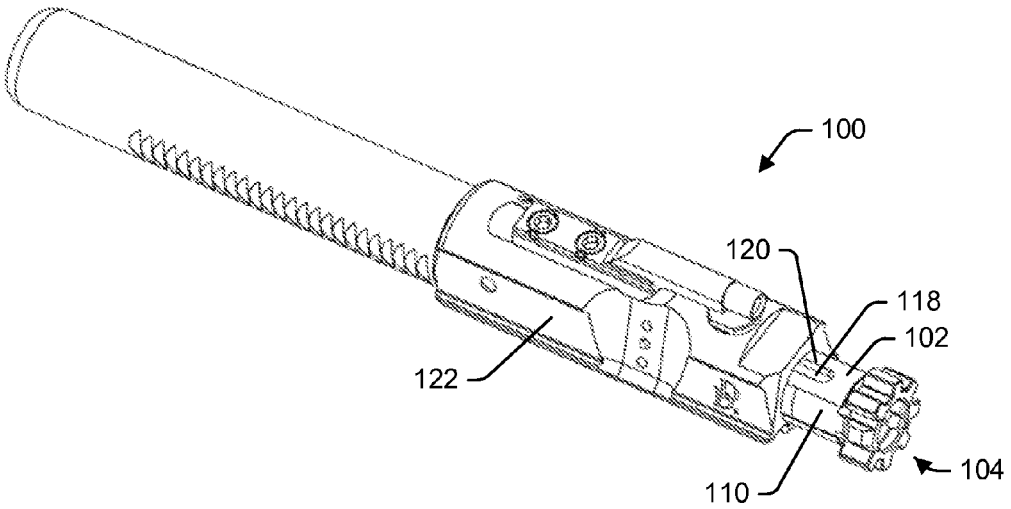
FIG. 4 depicts a perspective view of a bolt carrier group of a firearm in accordance with one or more embodiments of the disclosure.

A bolt 102 is depicted in FIGS. 1-3. A bolt carrier group 100 is depicted in FIG. 4. The bolt carrier group 100 may include a bolt 102 comprising a front end 104 and a rear end 106. The bolt 102 also may include a passage 108. The passage 108 may comprise a circular bore or the like extending at least partially through the bolt 102. The bolt carrier 100 also may include an extractor 110. The extractor 110 may include a hole 112. An extractor pin 114 comprising an elongated circular body 116 may be positioned within the passage 108 and the hole 112 to pivotably attach the extractor 110 to the bolt 102.

In some instances, the extractor pin 114 may include a transverse tab 118 extending from one end of the elongated circular body 116. In this manner, the elongated circular body 116 and the tab 118 may form a right angle with one another. An outer surface of the bolt 102 may include a slot 120 that corresponds to the tab 118. In this manner, the tab 118 may nest within the slot 120. Accordingly, when the bolt 102 is positioned within a bolt carrier 122, as depicted in FIG. 4, the bolt carrier 122 may at least partially surround the tab 118 and slot 120 to retain the tab 118 within the slot 120. In order to remove the extractor pin 114 from the bolt 102, the bolt 102 may be removed from the bolt carrier 122.

In certain embodiments, the slot 120 may extend rearward from the passage 108. That is, the slot 120 may start at the passage 108 and extend towards the rear end 106 of the bolt 102. For example, the slot 120 may extend rearward from the passage 108 parallel to an axial axis of the bolt 102. In other instances, the outer surface of the tab 118 may be slightly recessed within the slot 120 such that it is offset below the outer surface of the bolt 102.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A bolt carrier group of a firearm, comprising:
a bolt carrier;
a bolt comprising a passage;
an extractor comprising a hole; and
an extractor pin comprising an elongated circular body positioned within the passage and the hole to pivotably attach the extractor to the bolt, wherein the extractor pin comprises a transverse tab extending from one end of the elongated circular body.

2. The bolt carrier group of claim 1, wherein an outer surface of the bolt comprises a slot that corresponds to the tab.

3. The bolt carrier group of claim 2, wherein the tab nests within the slot.

4. The bolt carrier group of claim 3, wherein when the bolt is positioned within the bolt carrier, the bolt carrier at least partially surrounds the tab and slot to retain the tab within the slot.

5. The bolt carrier group of claim 4, wherein the bolt must be removed from the bolt carrier to remove the extractor pin.

6. The bolt carrier group of claim 2, wherein the slot extends rearward from the passage.

7. The bolt carrier group of claim 2, wherein the slot extends parallel to an axial axis of the bolt.

8. A retention assembly for a bolt carrier group of a firearm, the retention assembly comprising:
a bolt comprising a passage;
an extractor comprising a hole; and
an extractor pin comprising an elongated circular body positioned within the passage and the hole to pivotably attach the extractor to the bolt, wherein the extractor pin comprises a transverse tab extending from one end of the elongated circular body.

9. The assembly of claim 8, wherein an outer surface of the bolt comprises a slot that corresponds to the tab.

10. The assembly of claim 9, wherein the tab nests within the slot.

11. The assembly of claim 10, further comprising a bolt carrier, wherein when the bolt is positioned within the bolt carrier, the bolt carrier at least partially surrounds the tab and slot to retain the tab within the slot.

12. The assembly of claim 11, wherein the bolt must be removed from the bolt carrier to remove the extractor pin.

13. The assembly of claim 9, wherein the slot extends rearward from the passage.

14. The assembly of claim 9, wherein the slot extends parallel to an axial axis of the bolt.

15. A method for retaining an extractor pin in place in a bolt carrier group of a firearm, the method comprising:
providing a bolt carrier;
providing a bolt comprising a passage, wherein an outer surface of the bolt comprises a slot;
providing an extractor comprising a hole;
positioning an extractor pin comprising an elongated circular body within the passage and the hole to pivotably attach the extractor to the bolt, wherein the extractor pin comprises a transverse tab extending from one end of the elongated circular body; and
positioning the tab within the slot.

16. The method of claim 15, wherein the slot corresponds to the tab.

17. The method of claim 16, wherein the tab nests within the slot.

18. The method of claim 17, further comprising positioning the bolt within the bolt carrier, wherein the bolt carrier at least partially surrounds the tab and slot to retain the tab within the slot.

19. The method of claim 18, further comprising removing the bolt from the bolt carrier to remove the extractor pin.

20. The method of claim 16, wherein the slot extends rearward from the passage parallel to an axial axis of the bolt.

* * * * *